United States Patent [19]

Phillips

[11] Patent Number: 5,005,361

[45] Date of Patent: Apr. 9, 1991

[54] ION REPULSION TURBINE

[76] Inventor: Richard C. Phillips, 313 E. Haven Dr., Birmingham, Ala. 35215

[21] Appl. No.: 171,808

[22] Filed: Mar. 22, 1988

[51] Int. Cl.[5] ..... F01K 25/00

[52] U.S. Cl. ..... 60/671; 60/202

[58] Field of Search ..... 60/651, 671, 721, 202; 310/11

[56] References Cited

U.S. PATENT DOCUMENTS 4,104,875 8/1975 Birner et al. ..... 60/202

FOREIGN PATENT DOCUMENTS 57-38675 3/1982 Japan ..... 60/202

OTHER PUBLICATIONS

"Space Propulsion and Power", Power Engineering, Jan. 1961, pp. 56–57.

"How Close is a Practical Plasma Rocket", by Kurt R. Stehling, Space/Aeronautics, Mar. 1960, pp. 50–54.

*Primary Examiner*—Stephen F. Husar

[57] ABSTRACT

A turbine power plant which produces power from a high temperature plasma and high voltage electricity. A plurality of ion repulsion discharge chambers are situated along the perimeter of the turbine to accelerate the ions and a condenser and pump are used to return the condensed gases back to a plasma generator.

1 Claim, 7 Drawing Sheets

SEC. A–A

SEC. B–B

ION REPULSION TURBINE

The government has not sponsored any research or development monies or other aids in regard to this application:

No known related applications that have similar ion repulsion discharge chamber or plurality of chambers acting against a common shaft.

BACKGROUND OF THE INVENTION a. Technical Field

Drawn to a liquid/vapor ion power plant.

b. Description Of The Prior Art

The present state of the art ion engines produce very low thrust (pounds) due to their general construction and manner in which electrostatic forces act upon the positive ions. Low mass flow rates, used by the state of the art ion propulsion engines, would not be practical to use as an accelerator to produce enough kinetic energy for practical use in an ionic repulsion turbine as described in this application. The low kinetic energy is due to its general construction and manner in which the electrostatic forces act upon the ions. A simple analogy of the thrust of its propulsion principle would be similar to the manner in which ions might be ejected, in a small stream through an electrical field, by a TV picture tube. This system could operate over a long span of time; however, its thrust would be very low. This invention has overcome the low thrust problem in the present state of the art in the following areas:

1. The manner in which propellant enters the ion repulsion discharge chamber.

2. The utilization of a high voltage distributor which synchronizes electrical fields within the chamber.

3. The utilization of a uniquely construction separate polarization field which separates the net positive charge of the ions from the net negative charge of the ions within the propellant.

4. A separate, single acting electrode within each cylinder of the ion repulsion discharge chamber which repels the ions outwardly, and perpendicular to its surface, at an extremely high velocity.

SUMMARY

This is an ion engine which utilizes a form of ion propulsion to generate power from a turbine that is unique and unlike any ion propulsion system known to man.

Kinetic energy is derived from electrically neutral plasma by the unique construction of an ion repulsion discharge chamber and utilization of strategically located positive and negative conducting electrodes.

Briefly stated, a high temperature vaporized plasma is metered and injected into a uniquely constructed ion repulsion discharge chamber. Immediately, the plasma is acted upon by what is termed a polarization field. This field creates a separation between the net charge of the positive ions and the net charge of the negative electrons within the plasma. Since the plasma used is of metallic origin and has enormous amounts of free electrons, the separation of the net charges is accomplished at a very fast rate of speed in a strong electric field. Simultaneously, as the field is interrupted, another high voltage field is established which acts against the net positive charge of ions. This field repels (as opposed to expansion of gases thru a pressurized boiler) the ions and neutral plasma out of the chamber at an exceedingly high rate of speed.

Turbine rating is designed for electrical fields to pulse on the plasma at the rate of 30 times per second; however, fields can be pulsed at a rate of up to 800 times per second.

The discharged plasma strikes the turbine blades with a tremendous velocity which produces a torque to the turbine shaft. Faster pulse rates and higher recirculation rates of the plasma will produce a higher horsepower to the turbine drive.

The "spent" plasma is deflected to the bottom of the turbine where it is condensed, by cooling coils, into the liquid state.

The liquid plasma is pumped back to the vaporization chamber where it is heated and transformed back into a vapor and the process repeats itself.

This invention utilizes and acts upon ionized vapors to produce high velocity ions and a resulting high reaction thrust in a manner uniquely different from the latest state of the art. One feature of the motivating force to produce high velocity particles is the unique construction features and location of the electrodes embodied in the ion repulsion discharge chamber, which is radically different from any other known ion engines.

The second feature of the motivating force is the synchronization in which electrical fields are generated within the chamber. These fields act on the ions in three unique ways:

First, the different method in which the net positive charge from the negative charge are separated, and, second, the unique method in which the net positive is forced against the positive electrode and, thirdly, the thrust produced by this invention utilizes the following formula that the latest state of the art do not:

$$\text{Reaction Force} = \frac{[9 \times 10^9]\,[Q_1]\,[Q_2]}{R^2}\ \text{Newtons}$$

where $Q_1$ = Net positive charge of the ions $Q_2$ = Positive charge on (power) electrode R = Distance (meter) between the net positive charges and positive (power) electrode $9 \times 10^9$ = Constant involving speed of light (squared)

Force = Newtons

This turbine, utilizing ionized mercury as a propellant and acting against turbine blades, is more effective than using ionized water vapor for the following reasons:

1. At the same velocity and at the boiling point of each liquid, Hg (674 degrees F.) and water (212 degrees F.), and both at standard atmospheric pressure of 14.7 PSIA, the mercury vapor produces greater kinetic energy against the turbine blades than vapor due to its density being 6.7 times greater than water.

2. Also it will take 30 times less energy to increase the temperature of liquid mercury 1 degree F. than of water, and 7.6 times less energy to change mercury from its liquid state to its vapor state.

3. Also less electrical energy is required to ionize mercury vapors. Each atom of mercury has a very high number of electrons (80), with only one (1) in its outmost orbit, while each atom of water has only ten (10) electrons which are closely bound. Therefore, using the ionization method of "collision" it is very easy to knock off one or more electrons in the outmost orbit of the mercury atom, which are very loosely bound to its nucleus.

The above discussion only relates to the invention of Makoto Imamura (Japan) Japanese patent document 57-38675 published 3/8/82, however, since my invention utilizes a completely different principle as does Makoto Imamura's, it would be completely impractical to use water instead of mercury as a propellant for this invention.

DESCRIPTION OF THE PREFERRED EMBODIMENTS

The principal parts necessary to produce this invention are items that have already been proven in their fields.

Figure 1:
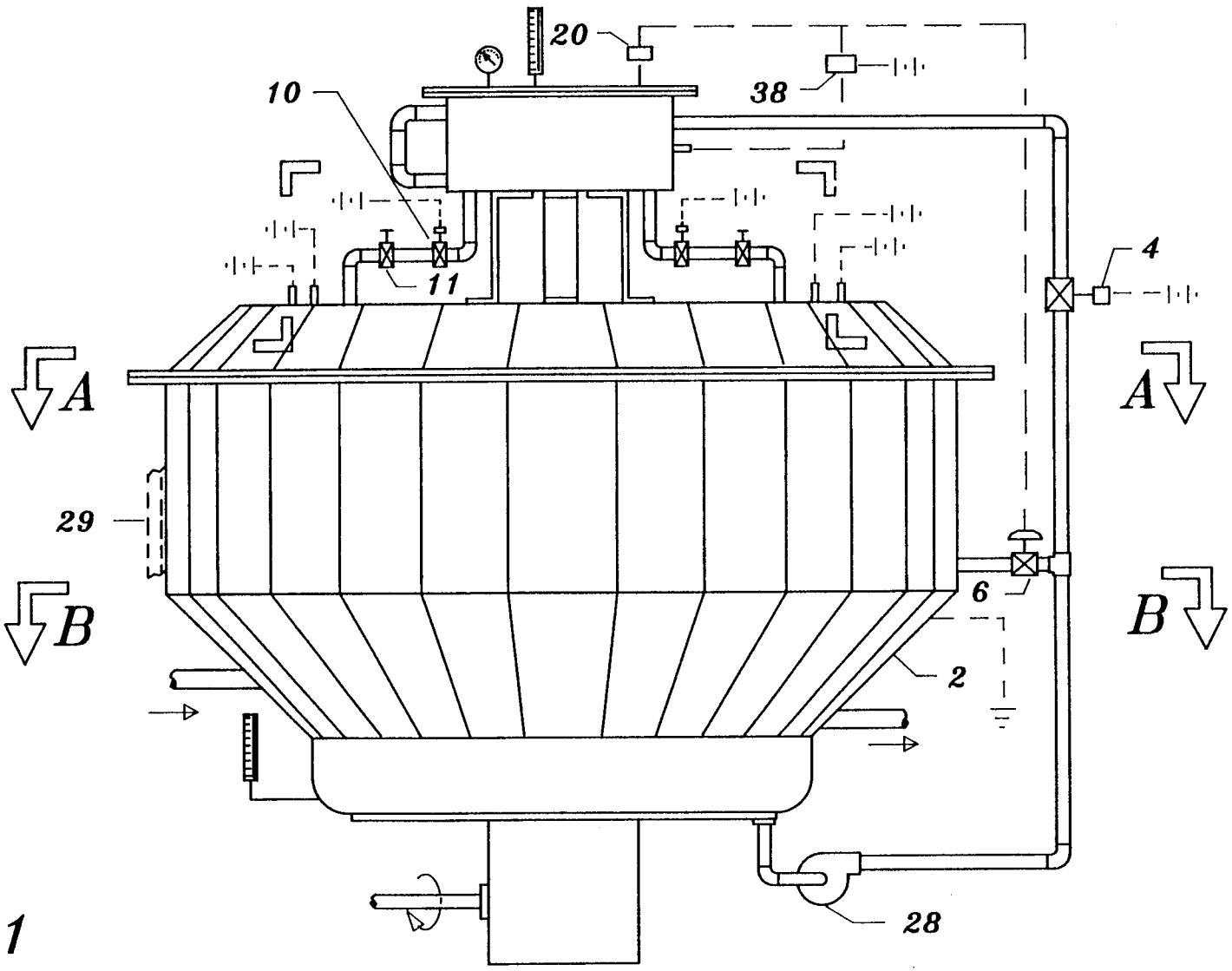
FIG. 1 is a general arrangement of the turbine front view.
Figure 2:
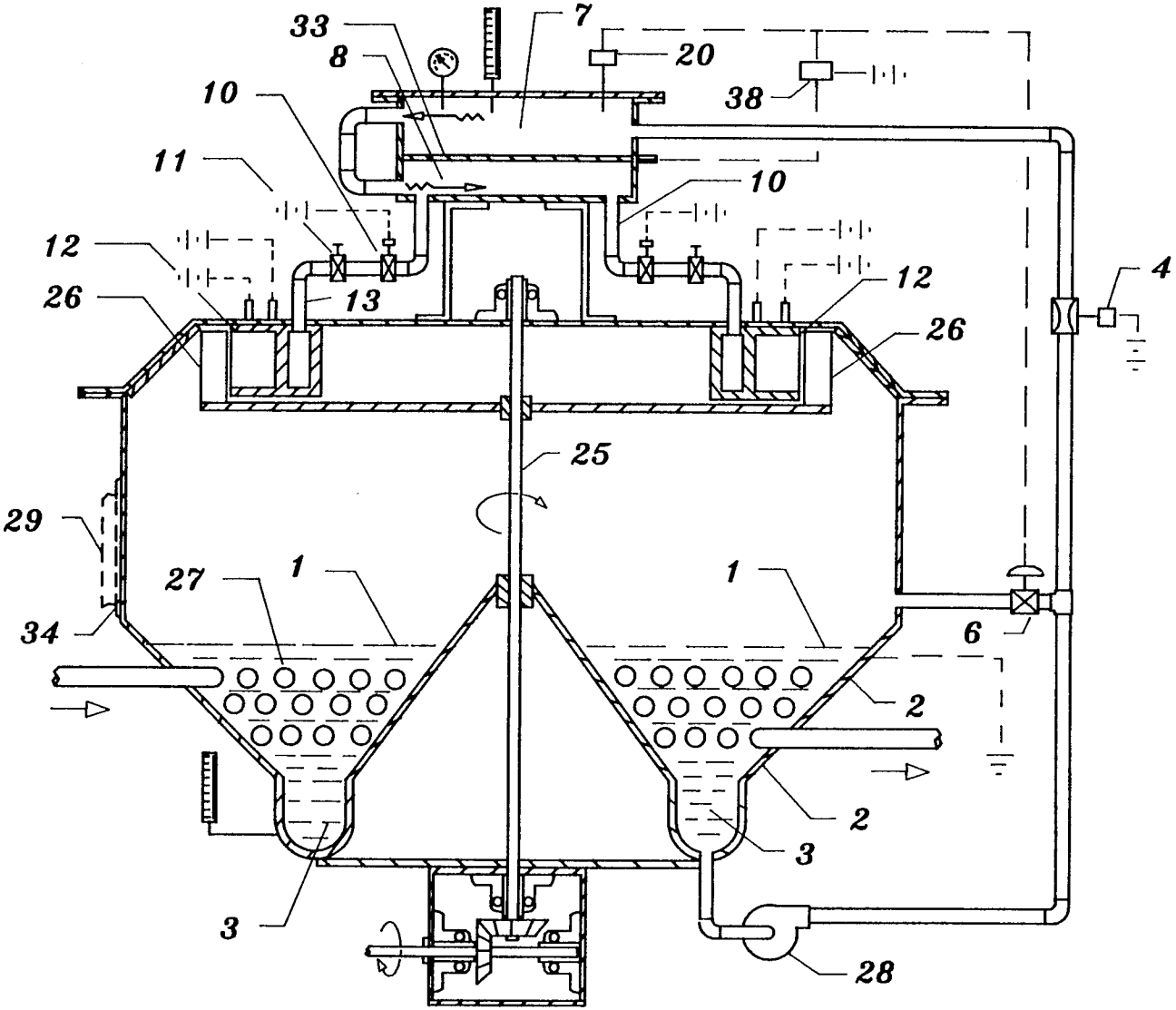
FIG. 2 is a longitudinal section through the center of the turbine.
Figure 3:
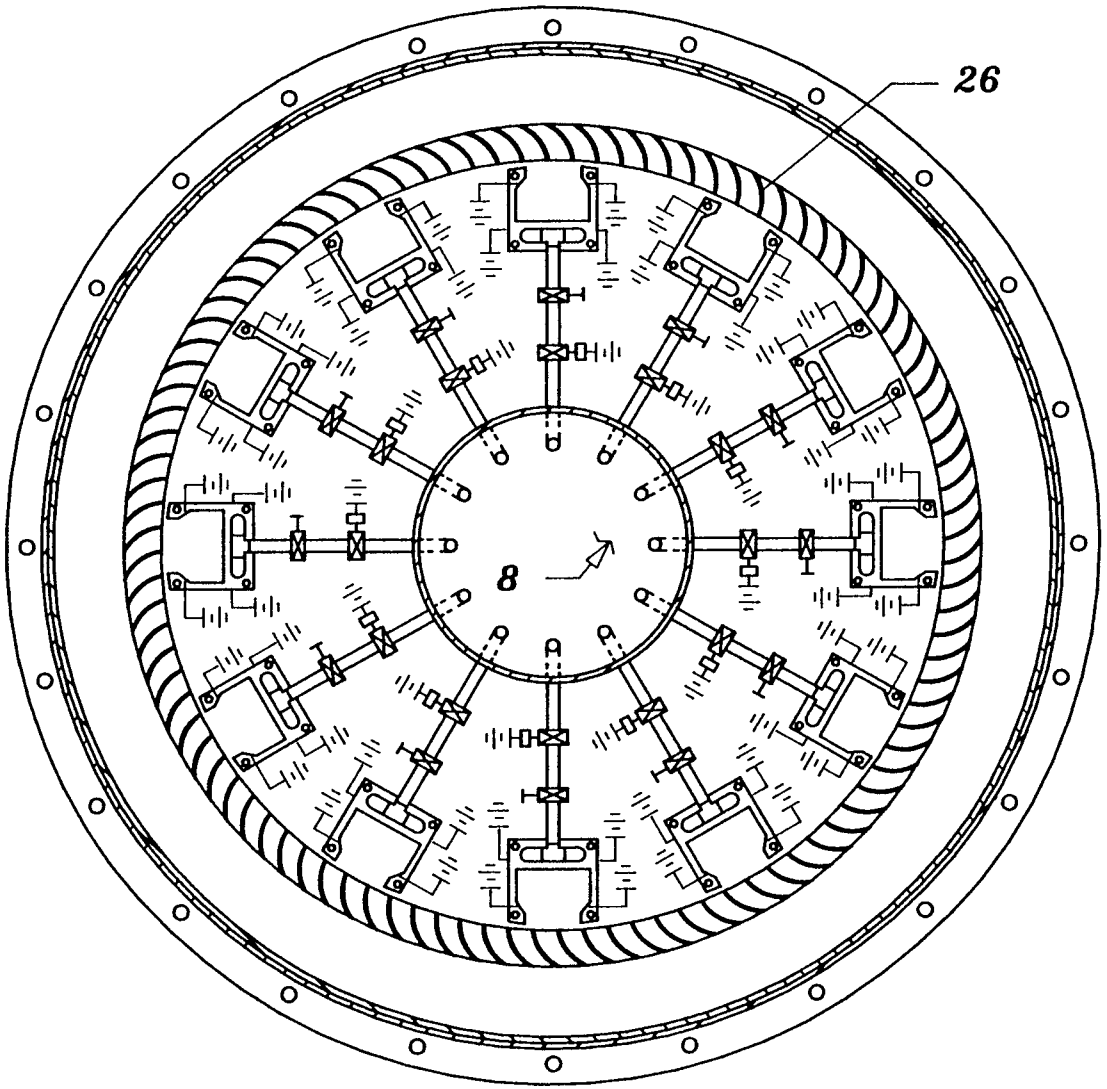
FIG. 3 is section A—A shown through the upper portion of the turbine body.
Figure 4:
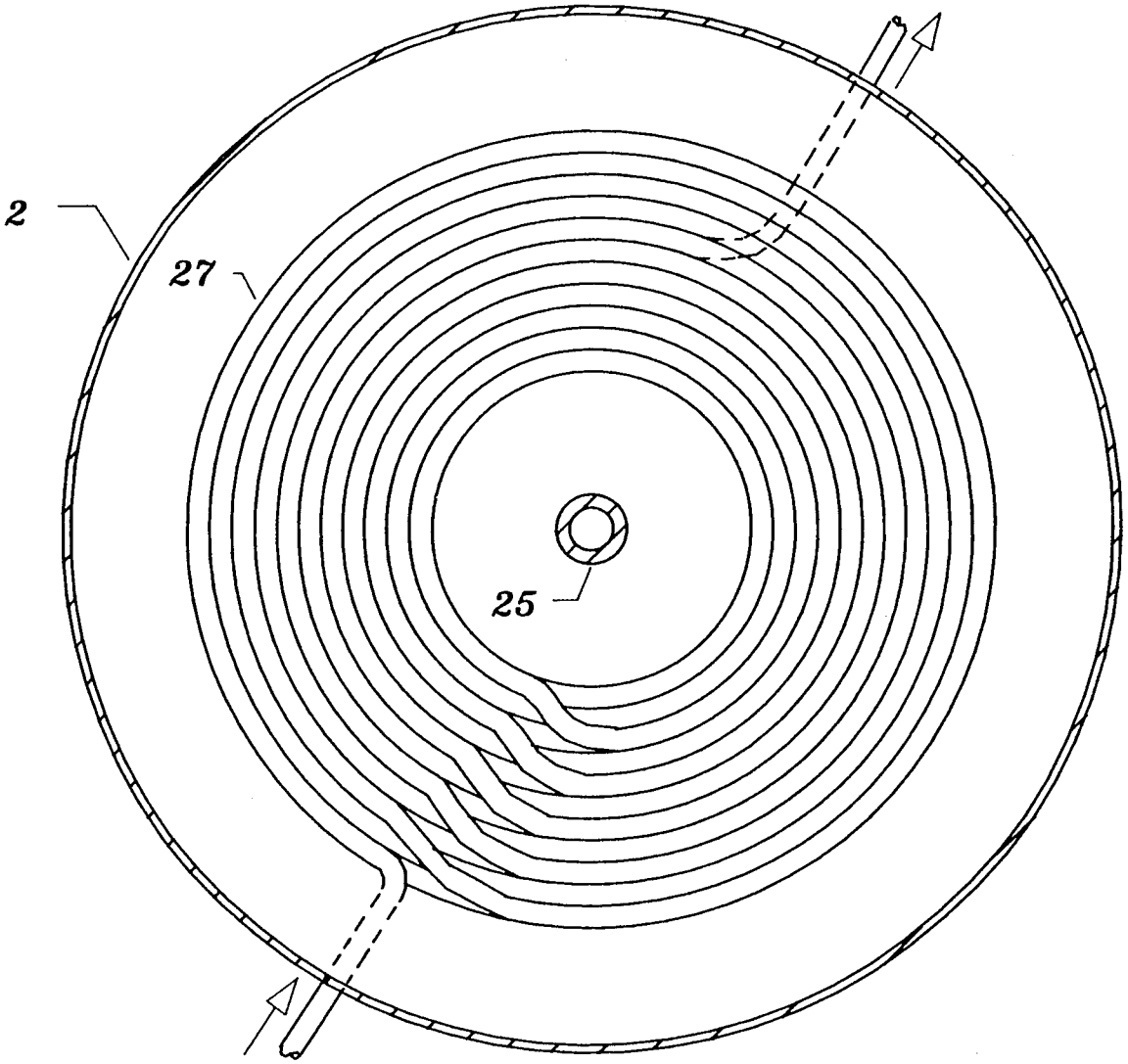
FIG. 4 is section B—B shown through the lower portion of the turbine body.
Figure 5:
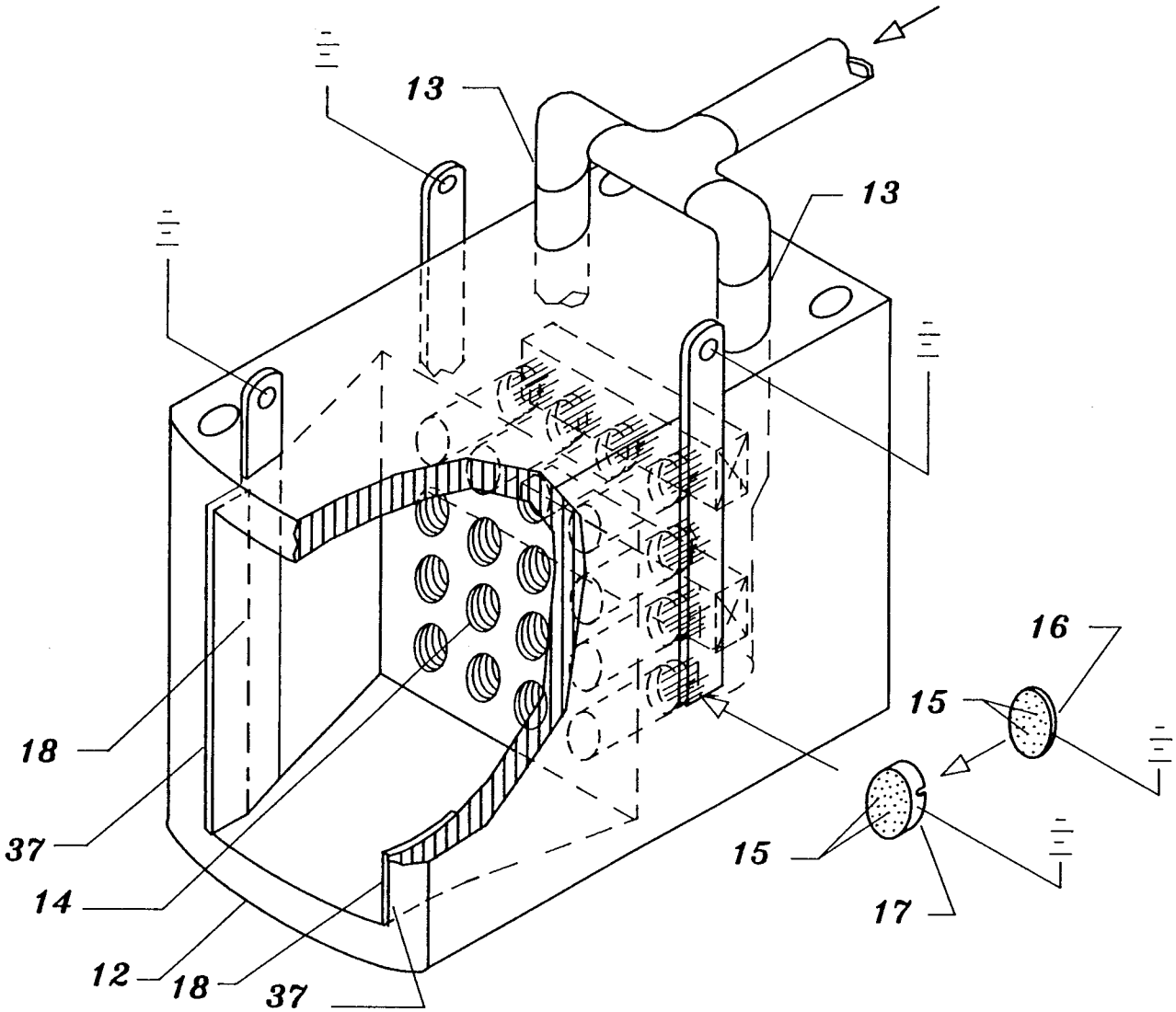
FIG. 5 is an isometric view of the propulsion head.

The necessary items to assemble this invention would be the following:

1. Storage batteries or some other DC electric power source.
2. Induction coils, 5 amps, 200 turn, 12 volt on primary windings; 20,000 turn, 20,000 volt on secondary windings.
3. Power supply interrupter, tungsten metal contacts similar to automotive points.
4. Spark plug wire to carry high voltage electricity to electrodes.
5. Variable speed motor to rotate high voltage contact, to distribute high voltage positive and negative electric charges.
6. Uniquely constructed ion repulsion discharge chamber as detailed on FIG. 5.
7. Electric Heating Coils, 5 K.W., necessary to vaporize liquid mercury.
8. Liquid pump, 2 GPM (max. capacity), necessary to pump mercury from condenser to vaporization chamber.
9. Solenoid valves, two way, to open and shut, allowing mercury vapor to enter chamber.
10. Needle valves to control flow of ionized vapor.
11. Tungsten turbine blades connected to a common shaft.
12. Turbine housing with tungsten metal internal deflector plates.
13. ⅛" lead radiation shield plate covering outer surface of steel turbine.
14. 2" thick "Calcium Silicate" insulation covering outer surface of turbine.
15. Stainless steel tubing air cooled condenser, ¾" dia×20 turns located at bottom of turbine.
16. Power train connected to turbine shaft to deliver horsepower. It is noted however, while specific embodiments of the invention have been shown and described in detail to illustrate the application of the principles of the invention, it will be understood that the invention may be embodied otherwise without departing from such principles.

The purpose of this turbine is to produce power from a high temperature plasma 7 and high voltage electricity. Units could be installed in automobiles, boats and aircrafts as an alternate power source which could generate power without releasing pollution to the atmosphere. The turbine uses a high temperature plasma mercury vapor 7 but is not limited only to mercy as the fuel to propel the turbine blades 26, hereafter called plasma.

The plasma is cooled by an air-cooled condenser 3 and the cycle starts with the plasma in the liquid state 1, located in the bottom of the turbine housing 2.

The liquid plasma 1 is pumped from the bottom of the condenser (3), through a flow control valve 4, and into a pressurized vaporization chamber 5. In the event of over-pressurization, the liquid plasma 1 is diverted back through a pressure regulating valve 6 into the turbine condenser 3, and the temperature controller 38 reduces the temperature of the heating coils 33.

Under normal operating conditions the liquid plasma 1 enters the pressurized vaporization chamber 5 where electric heating coils 33 quickly convert the liquid into a pressurized, vaporized, high temperature plasma 7.

From the vaporization chamber 5 the plasma 7 flow into a distribution manifold 8 which connects to separate fuels lines (9).

Each fuel line connects to a quick acting, on-off, solenoid valve 10. Plasma 7 then flows through a flow control needle valve 11, similar to a carburator, allowing only specific volume of plasma 7 into each ion repulsion discharge chamber 12.

Each chamber 12 has two (2) plasma inlet ports 13 to facilitate an even distribution of plasma 7 into each of the sixteen 16 chamber cylinders 14. Plasma 7 flows into each cylinder 14 through extremely small orifices 15, perforated in both the polarization disc electrode 16 and the propulsion disc electrode 17. The size of the orifices 15 is on the order of 0.003 inches in diameter and are located on 0.012 inch centers. This small orifice area allows an electric field to exist on over 95% of the surface of the electrodes.

Electric insulation 37, of a high dielectric strength, is provided around all inactive surfaces of electrodes to prevent electrical arcing.

Each ion repulsion discharge chamber 12 consists of the following:

a. Sixteen (16) propulsion disc electrodes 17 b. Sixteen (16 ) polarization disc electrodes 16, each located inside each of the sixteen (16) propulsion disc electrodes 17.

c. Two (2) polarization plate electrodes 18, one located at each chamber opening 19.

The total number of ion repulsion discharge chambers 12 described in this invention is twelve (12); however, there may be more or less than twelve (12) chambers 12 located within a given turbine. The total number would depend upon the turbine size and use requirement. This invention claims the application for any number or size and for whatever the design application may be.

A specific volume of plasma is metered into each cylinder 14 by utilization of the following:

a. Operation of the quick-acting, on-off, solenoid valve 10.

b. Utilization of the flow control valve 11.

c. Maintaining of plasma system constant pressure; this is controlled by the utilization of the sensor/pressure controller 20, located at the vaporization chamber 5, and actuation of the pressure regulating valve 6 which discharges liquid into the turbine condenser 3 when over-pressurization of system occurs.

As the quick-acting, on-off solenoid valve 10 is actuated, plasma 7 enters each of the cylinders 14 while a high voltage polarization field 21 simultaneously acts on the plasma 7 which contains enormous numbers of free positive ions and free negatively charged electrons 32.

The polarization field 21 consists of the polarization disc electrodes 16, one located within each of the cylinders 14, which carry a negative charge, and two (2) polarization plate electrodes 18, one located on opposite sides of the chamber opening 19, which carry a positive charge.

The electrical power necessary to produce these fields are furnished by induction coils 36, and the proper voltage is regulated by voltage regulators 31, and is distributed by rotating contacts 30. The electrical pulse rate to the solenoid valve 10 and ion repulsion discharge chamber 12 is regulated by the variable speed motor 39.

Figure 7:
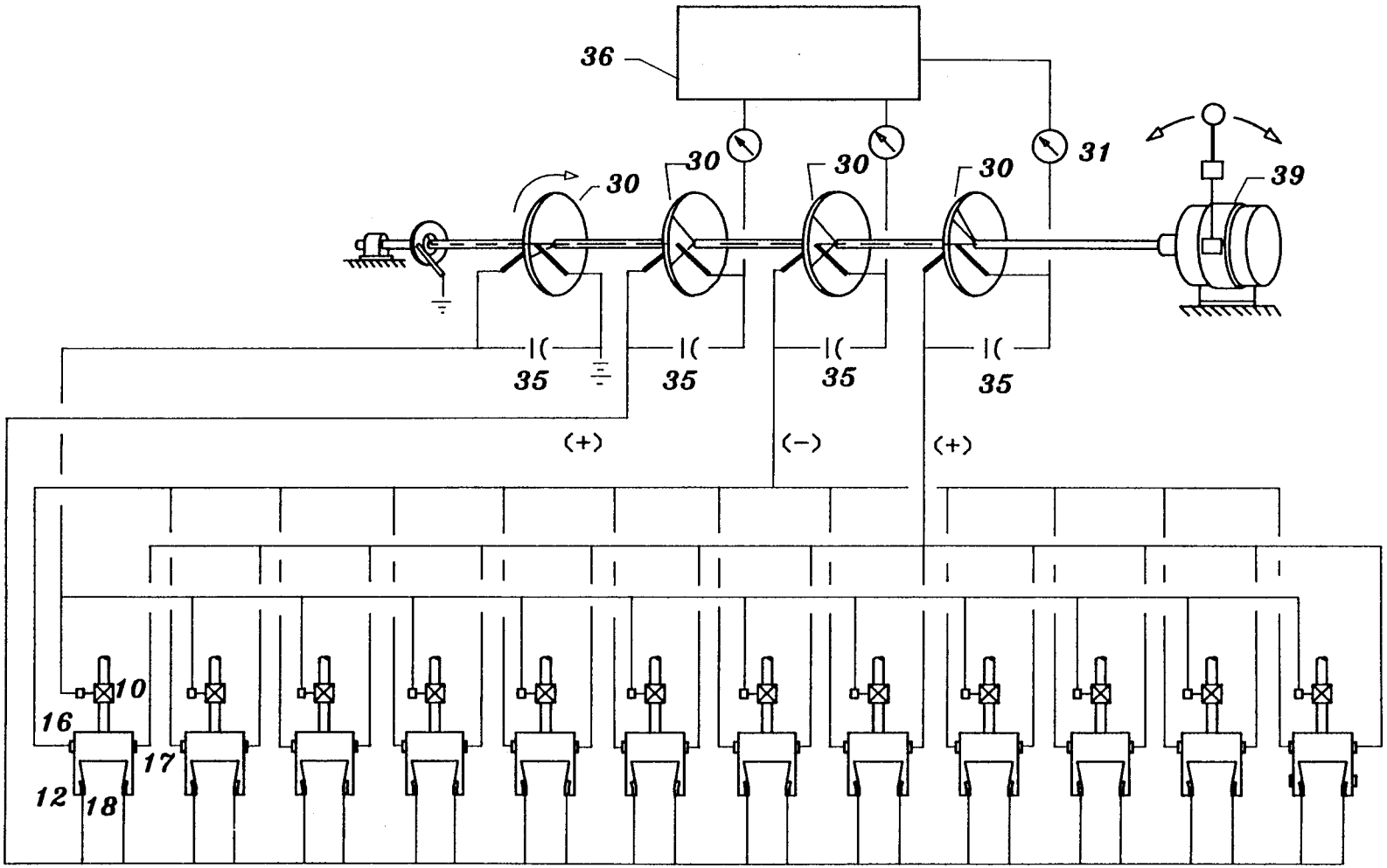
FIG. 7 is an electrical power schematic to depict how high voltage electricity is distributed to the propulsion heads.

Electrical arcing is prevented at the rotating contacts 30 by the use of capacitors 35. Electrical wiring schematic showing these circuits are described on FIG. 7.

The basic function of the polarization field 21 is to produce a separation (distance) between the net charge of the free positive ions 22, and the net charge of the free negatively charged electrons 23 within each of the chamber cylinders 14.

While this field 21 is acting, an enormous number of free electrons 32, within the plasma 7 are ejected from each chamber cylinder (14) through the chamber opening 19, thus producing a net overall positive state of ionization on the plasma 7 while the plasma 7 remains in each of the chamber cylinders 14.

The polarization field 21 forces the ionized, positively charged plasma 7, to the bottom of each cylinder 14, due to the design of the chamber 12, with the negative charge of the field located on the polarization disc electrode 16, which is located at the bottom of each cylinder 14, and the positive electrodes 18, located on the side of the chamber opening 19. Simultaneously, two phenomena occur within the plasma. FIrst, while plasma 7 is filling each chamber cylinder 14 with the polarization field 21 acting during this period of time, an enormously high net positive charge 22 is created by the free ions and is forced against the surface of each of the propulsion disc electrode 17. This occurs due to the electrostatic principle that free positive charges travel in an electric field toward the negative electrode or, in this case, toward the polarization disc electrode 16. The propulsion disc electrode 17 is located immediately in front of the polarization disc electrode 16; therefore the net positive charges of the ions 22 amass on the surface of the propulsion disc electrode 17, which is as close as possible to the negative charge of the polarization disc electrode 16.

Secondly, this field also produces an enormously high net negative charge 23 of electrons to amass on the plasma 7, inside each of the cylinders 14, as far away as possible from the negative charges of the polarization disc electrode 16. Simultaneously, the positive charge on the polarization plate electrodes 18 attracts the electrons toward the opening of the ion repulsion discharge chamber 19.

The final result achieved by the polarization field 21 acting on the plasma 7 is the creation of a separation between the net positive charges of the ions 22 and the net negative charges of the electrons 23 while the plasma 7 remains inside the chamber cylinders 14. It is noted that the greater the voltage of the polarization field 21, up to a point where total ionization occurs, the greater the separation of the net positive and net negative charges.

The time span necessary for polarization of the plasma is very short since mercury vapor is a metal and, as discussed earlier, contains huge numbers of ions and electrons. At a predetermined and very short time span, the polarization field 21 is suddenly interrupted and, simultaneously, as it is falling, the ion repulsion field 24 is initiated on the propulsion disc electrodes 17. (See FIG. 7, Electrical Wiring Schematic depicting the action of the rotating contacts 30 to interrupt and start electric fields.) The net positive charge of the ions 22 and the net negative charge of the electrons 23 do not have any time whatsoever to redistribute themselves into a homogenous electrically neutral mixture. The reason for this is as follows:

The contacts to de-energize the polarization field 21 and to energize the ion repulsion field 24 are acted upon simultaneously through the rotating contacts 30, and once the current goes through the rotation contacts 30, it only takes $10^{-17}$ second for the polarization field 21 to fall and $10^{-17}$ second for the ion repulsion field 24 to be established.

As the ion repulsion field 24 is energized, the following action takes place within each of the cylinders:

The net positive charges on the ions 22 which have amassed against the surface of the propulsion disc electrode 17 have formed what is analogous to a "charge piston". As the newly established ion repulsion field 21 is set up on the outer surface of the propulsion disc electrode 17, this "charged piston" is instantly repelled perpendicularly away from the surface of each positively charged propulsion disc electrode 17 and forces all electrically neutral plasma and electrons located in front of the positive charges out of the chamber cylinders 14 at an extremely high velocity.

Figure 6A:
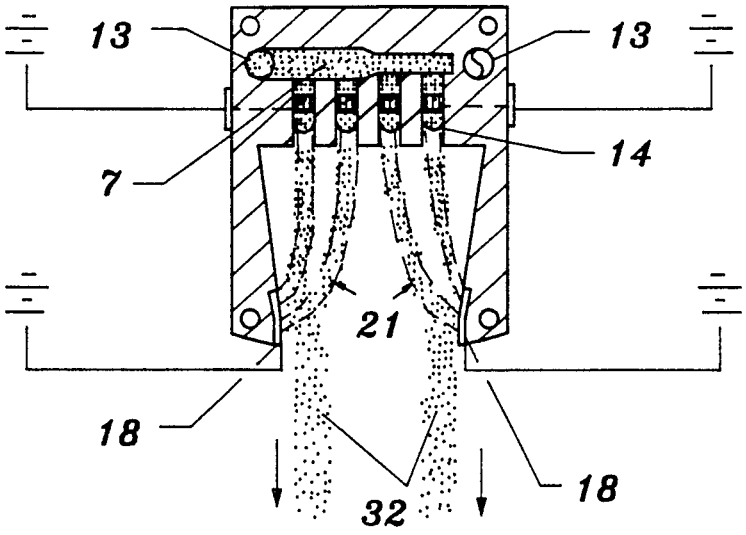
FIG. 6A, B, C is a diagrammatic description of the polarization and propulsion fields acting on the plasma.
Figure 6B:
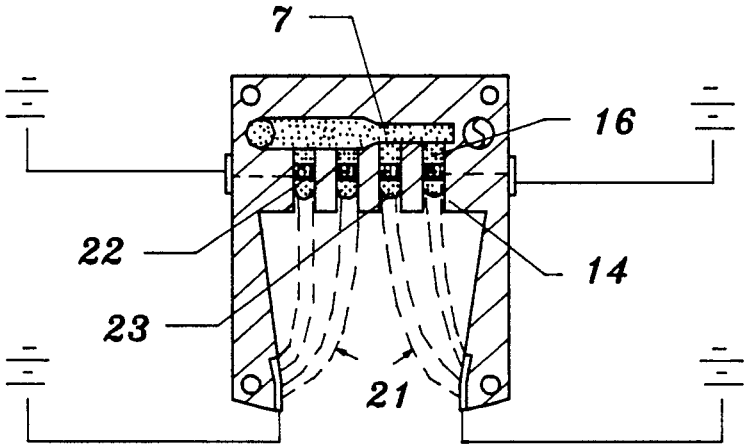
Figure 6C:
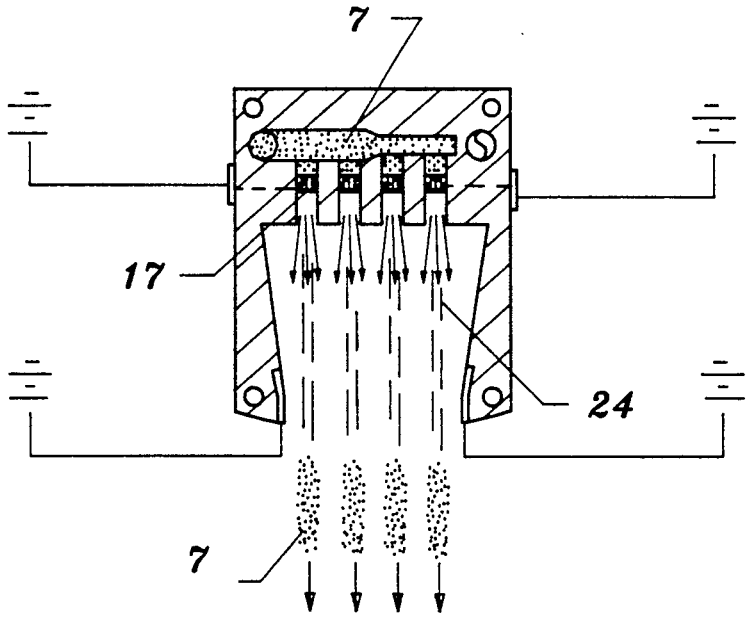

There are no electrical fields to resist the repulsion of the positive ions since the normally positively charged polarization plate electrodes 18, located at the chamber opening 19, is off. Therefore, the high velocity plasma passes unrestricted through the opening 19 and immediately strikes the turbine blades 26, thus imparting a torque to the shaft 25. (FIG. 6*a*, *b* and c show diagramatically the action described by this process.) The "spent" plasma, in its electrically neutral state, is deflected downward to the turbine condenser 3 where cooling coils 27 condense the vapor into the liquid state.

A pump 28, located beneath the condenser, discharges the liquid back into the vaporization chamber 5 and the cycle repeats itself. This invention uses only one (1) set of turbine blades 26, for simplicity; however, the claim of this invention also includes the use of multiple blades, similar to a steam turbine, to derive greater horsepower from the available kinetic energy of the high velocity plasma.

Some radiation is emitted due to the collision of the high velocity atomic particles; therefore lead shielding 34 is required at impacted areas for personnel safety. Calcium silicate insulation 29 covers all outer surfaces of the turbine, except gauges and controls, to retain internal heat within the liquid and to provide necessary personnel safety conditions.

Formulae applicable to Invention

The following formulae are shown to depict how kinetic energy is produced in only one (1) cylinder 14 of the ion repulsion discharge chamber 12. To determine the total force of the turbine, the result must be multiplied by the number of cylinders 14 within the turbine.

The calculation to determine the net positive charge of the ions 22 within one (1) cylinder 14 is as follows:

Calculation 1:

$$Q_1\ (22) = \frac{\text{Voltage (Pot.)} \times \text{Area} \times K_1 \times K_2}{4 \times \pi \times (9 \times 10^9) \times d}$$

$Q_2$ (23)=Net charge of electrons is an opposite charge of $Q_1$ (22) as electrons are repelled within the plasma at some "X" distance away where:

$Q_1$(22)=Net charge in coulombs $$\text{Voltage (Pot.)} \begin{cases} + \text{ Voltage (18)} \\ - \text{ Voltage (16)} \end{cases}$$

Area=(Meter)$^2$-Polarization disc electrode (16)

d=(Meters) between electrodes (18 and 16)

$K_1$=Constant-determined by the type of plasma used and the pressure and temperature $K_2$=Constant-use factor of 2 for etched surface of polarization disc electrode (16)

Calculation 2:

Determination of the net repulsion force of the ions.

Discussion:

From the computation of the net positive charge within the ions, the net repulsion force on the ions, within each cylinder 14 can be computed.

As the positive charge is set up on the propulsion disc electrode 17, and acts on the net positive charge of the ions 22, (analogous to a "charged piston") and starts to repel it from the cylinder 14, simultaneously, this field is acting on the net negative charge of the electrons 23, attracting it toward the propulsion disc electrode 17. As this field acts on both positive and negative charges, an "electrical collision" occurs inside each of the cylinders 14, producing high intensity light and greater ionization of the positive ions. The following formulae will show the difference of force between the repulsion force generated by the ions as they are repelled by the positive charge on the repulsion disc electrode 17, and the attracting force generated by the net charge of the electrons 23.

$$(+)\ \text{Force}_1\ \text{(Positive Ions Repelled)} = \frac{(9 \times 10^9)\ (+Q_1)\ (+Q^3)}{(d_1)^2}$$

↑

Simultaneous Action

↓

$$(-)\ \text{Force}_2\ \text{(Negative Electrons attracted)} = \frac{(9 \times 10^9)\ (-Q_2)\ (+Q_3)}{(d_2)^2}$$

Where:

$\text{Force}_1$=Newtons $+Q_1$=Net positive charge ions (22) from calc. 1

$+Q_3$=Variable-Coulomb charge set up on propulsion disc electrode $d_1$=(Meter) distance between charges Where:

$\text{Force}_2$=Newtons $-Q_2$=Net negative charge of electrons (23) from calc. 1

$+Q_3$=Same $Q_3$ above $d_2$=(Meter) distance between charges

From the following equation (Formula for $\text{Force}_1$), it is noted:

$$\text{Force}_1\ \text{(Ions repelled)} = \frac{(9 \times 10^9)\ (+Q_1)\ (+Q_3)}{(d_1)^2}$$

$+Q_1$ (Net positive charge of ions) and $+Q_3$ (Charge set up on the propulsion disc electrode 17) are adjacent to each other when charge $+Q_3$ is set up; therefore, Distance $d_1$ is almost zero (0). As the Distance $d_1$ approaches zero (0), which is in the denominator in the above equation, the force (in Newtons) approaches infinity.

From the following equation (Formula for $\text{Force}_2$), it is noted:

$$\text{Force}_2\ \text{(Electrons attracted)} = \frac{(9 \times 10^9)\ (-Q_2)\ (+Q_3)}{(d_2)^2}$$

$-Q_2$ (Net negative charge of electrons) and $+Q_3$ (Charge set up on the propulsion disc electrode 17) are separated by a relatively large Distance $d_2$ as compared to Distance $d_1$. When actual values a substituted in these equations, it can be shown that the attracting force of the electrons is negligible.

Calculation 3:

From calculation 2, the net average force acting on the ions can be computed and the acceleration of the plasma 7 is as follows:

Acceleration=Force/Mass

Where:

Acceleration=Meter/Second$^2$

Force=Newton (from calculation 2)

Mass=Kilogram (controlled by the flow control valve)

Calculation 4:

From calculation 3, the acceleration of the plasma can be computed, and the formula for the velocity is as follows:

Velocity=2(Acceleration)(Y)

Where:

Acceleration=Meter/Second$^2$ l=(Distance from propulsion disc electrode 17 to chamber opening 19)

Calculation 5:

From calculation 4, the velocity of the plasma can be computed, and the formula for the kinetic energy is as follows:

Kinetic Energy=$\frac{1}{2}$ (Mass) (Velocity)$^2$

Where:

Kinetic Energy = Joules
Mass = Kilogram/Pulse
Velocity = Meter/Second
Calculation 6:

From calculation 5, the kinetic energy of the plasma for one (1) cylinder can be computed, the total kinetic energy for the turbine is as follows:

Total Kinetic Energy of Turbine = (K.E. for one [1] cylinder) (Total number of cylinders)

I claim:

1. An ion turbine comprising: means for generating an ionized gas, a plurality of uniguely designed ion repulsion discharge chambers which accelerate the ions of the ionized gas at an extremely high velocity through the use of strategically located electrostatic fields, said ion repulsion discharge chambers being situated along the inner perimeter of a set of turbine blades within a turbine, a condenser connected to the outlet of the turbine and a pump connected to the outlet of the condenser returning the condensed gas back to the means for generating the ionized gas.

* * * * *